US008519331B2

(12) United States Patent
Bateman et al.

(10) Patent No.: US 8,519,331 B2
(45) Date of Patent: Aug. 27, 2013

(54) MASS SPECTROMETER

(75) Inventors: Robert Harold Bateman, Cheshire (GB); Martin Green, Cheshire (GB); Jason Lee Wildgoose, Stockport (GB)

(73) Assignee: Micromass UK Limited, Manchester (GB)

( * ) Notice: Subject to any disclaimer, the term of this patent is extended or adjusted under 35 U.S.C. 154(b) by 456 days.

(21) Appl. No.: 12/528,173

(22) PCT Filed: Feb. 21, 2008

(86) PCT No.: PCT/GB2008/000617

§ 371 (c)(1),
(2), (4) Date: Sep. 23, 2010

(87) PCT Pub. No.: WO2008/102155

PCT Pub. Date: Aug. 28, 2008

(65) Prior Publication Data

US 2011/0057097 A1 Mar. 10, 2011

Related U.S. Application Data

(60) Provisional application No. 60/895,212, filed on Mar. 16, 2007.

(30) Foreign Application Priority Data

Feb. 21, 2007 (GB) ..... 0703378.0

(51) Int. Cl.
*H01J 49/42* (2006.01)
*H01J 49/00* (2006.01)

(52) U.S. Cl.
CPC ..... *H01J 49/0095* (2013.01); *H01J 49/423* (2013.01); *H01J 49/424* (2013.01)
USPC ..... 250/292

(58) Field of Classification Search
USPC ..... 250/292
See application file for complete search history.

(56) References Cited

U.S. PATENT DOCUMENTS

| | | | | |
|---|---|---|---|---|
| 5,576,540 | A | 11/1996 | Jolliffe | |
| 5,625,186 | A * | 4/1997 | Frankevich et al. | 250/292 |
| 6,483,109 | B1 | 11/2002 | Reinhold et al. | |
| 6,797,950 | B2 * | 9/2004 | Schwartz et al. | 250/292 |
| 6,844,547 | B2 * | 1/2005 | Syka | 250/292 |
| 6,998,610 | B2 * | 2/2006 | Wang | 250/290 |
| 2004/0149903 | A1 | 8/2004 | Wang | |

FOREIGN PATENT DOCUMENTS

| | | |
|---|---|---|
| WO | 9214259 | 8/1992 |
| WO | 03067623 | 8/2003 |
| WO | 2004/017358 | 2/2004 |
| WO | 2004063702 | 7/2004 |
| WO | 2007112549 | 10/2007 |
| WO | 2008008634 | 1/2008 |

* cited by examiner

*Primary Examiner* — Jack Berman
(74) *Attorney, Agent, or Firm* — Diederiks & Whitelaw, PLC

(57) ABSTRACT

A mass spectrometer is disclosed comprising a 2D or 3D ion trap. The 2D ion trap comprises a quadrupole rod set ion trap wherein a slot is provided in each of the rods to allow ions to be ejected radially from the ion trap. The 3D ion trap comprises a central ring electrode which is radially segmented and wherein a slot is provided in each radial segment to allow ions to be ejected radially from the ion trap. Ions having different mass to charge ratios and/or opposite polarities may be simultaneously ejected from the ion trap via different exit pathways.

15 Claims, 16 Drawing Sheets

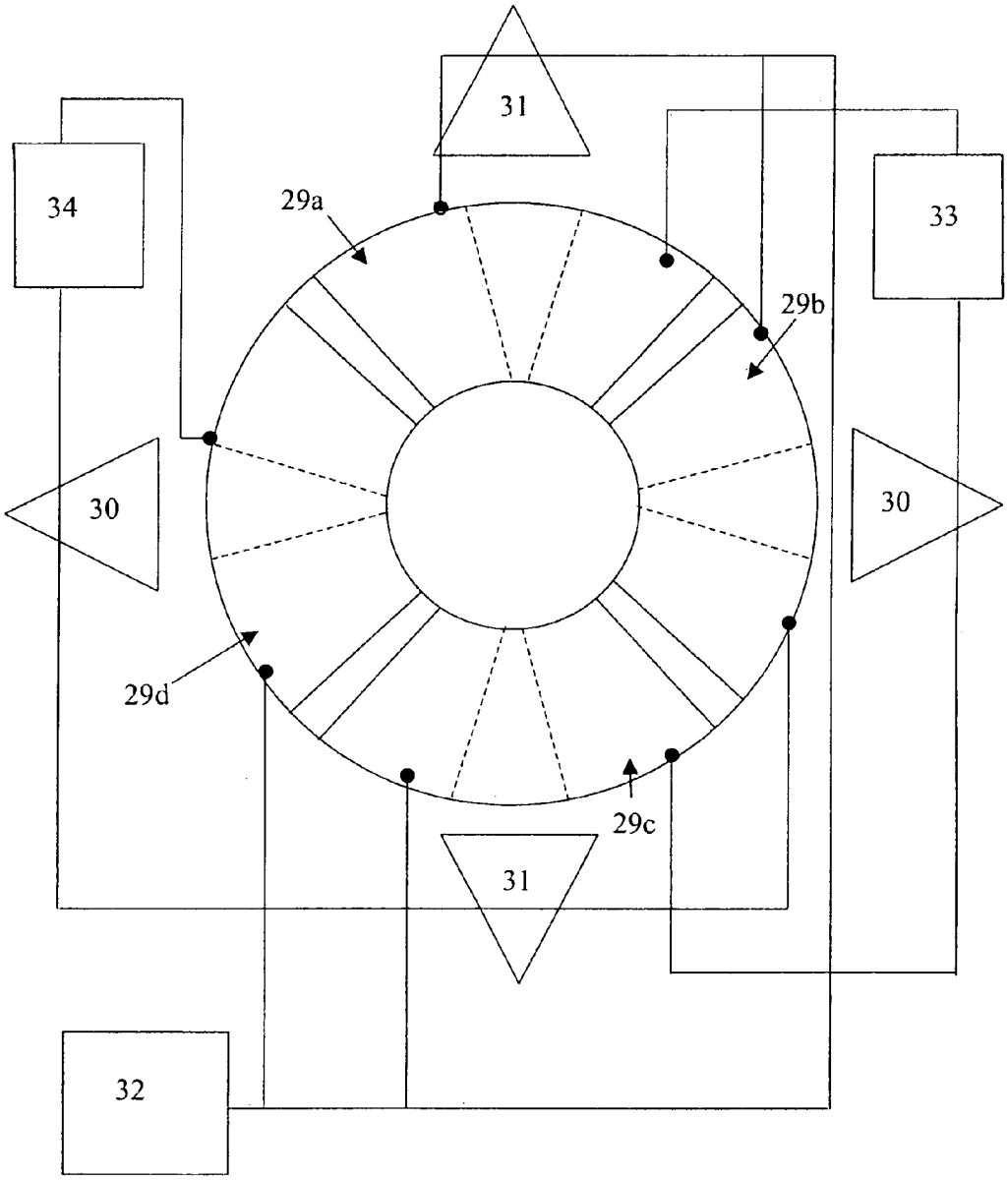
FIG. 12
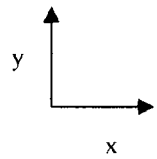

MASS SPECTROMETER

CROSS REFERENCE TO RELATED APPLICATIONS

This application is the National Stage of International Application No. PCT/GB2008/000617, filed Feb. 21, 2008, which claims priority to and benefit of United Kingdom Patent Application No. 0703378.0, filed Feb. 21, 2007 and U.S. Provisional Patent Application Ser. No. 60/895,212, filed Mar. 16, 2007. The entire contents of these applications are incorporated herein by reference.

BACKGROUND OF THE INVENTION

The present invention relates to an ion trap, a mass spectrometer, a method of trapping ions and a method of mass spectrometry.

Three dimensional (or Paul) ion traps comprising a central ring electrode and two end-cap electrodes are well known. Similarly, two dimensional or linear ion traps comprising quadrupole rod set ion guide with two end electrodes are also well known.

It is known to mass selectively eject ions from a conventional ion trap in a sequential manner by scanning or stepping the amplitude of an RF voltage which acts to confine ions within the ion trap. Alternatively, the frequency of a supplemental excitation potential which is applied to the electrodes of the ion trap may be scanned or stepped.

Ions having differing mass to charge ratios may be simultaneously ejected from a conventional ion trap by applying two supplementary excitation potentials to the electrodes forming the ion trap. The two supplementary excitation potentials have different frequencies. Ions which are subsequently ejected from the ion trap all follow the same exit route out from the trapping region.

It is known that RF ion traps may be used to contain simultaneously both positive and negative ions. This enables ion-ion interactions to be utilised to effect ion fragmentation or reaction in the gas phase.

The conventional approach of sequentially ejecting ions having differing mass to charge ratios from an ion trap limits the speed at which an analytical scan can be accomplished without degrading performance. It is known that the mass resolution achieved when ejecting ions by resonance ejection or by mass selective instability reduces as the speed of the analytical scan increases.

In general, the mass resolution is proportional to the number of resonance field periods that an ion experiences before it is ejected. Highest resolution is generally achieved when ion ejection occurs over extended time periods with the minimum amplitude of auxiliary excitation potential needed to effect ejection.

The speed at which the frequency or amplitude of a confining RF potential may be scanned or stepped during an analytical scan is also limited by the electronic circuit used. This will also limit the speed of analysis.

Another problem with known ion traps is that it is not possible to mass analyse individually and simultaneously positive and negative ion species from a given ion-ion reaction within the ion trap. Ions having different polarities but having the same or substantially similar mass to charge ratios will have the same frequency of oscillation within the ion trap. Therefore, conventionally, mass spectra may only be produced which correspond with the sum of the positive and negative ions residing in the ion trap without it being possible to distinguish between ions having different polarities.

It is therefore desired to provide an improved ion trap.

SUMMARY OF THE INVENTION

According to an aspect of the present invention there is provided an ion trap comprising a plurality of electrodes wherein in a first mode of operation ions having substantially different mass to charge ratios and/or opposite or different polarities are simultaneously ejected from the ion trap via separate, different, discrete or non-overlapping exit paths, pathways or routes.

The ion trap preferably further comprises one or more holes, slots or apertures in at least some of the plurality of electrodes. Ions having a first mass to charge ratio and/or a first polarity are preferably arranged and adapted to exit the ion trap solely via a first exit path, pathway or route which passes through one or more first holes, slots or apertures. Ions having a second different mass to charge ratio and/or a second opposite polarity are preferably arranged and adapted to exit the ion trap solely via a second different exit path, pathway or route which preferably passes through one or more second different holes, slots or apertures.

According to an embodiment either: (a) the first exit path, pathway or route is inclined at an angle θ1 relative to the second exit path, pathway or route, wherein θ1 is selected from the group consisting of: (i) 5-20°; (ii) 20-40°; (iii) 40-60°; (iv) 60-80°; (v) 80-100°; (vi) 100-120°; (vii) 120-140°; (viii) 140-160°; (ix) 160-175°; and (x) 90°; and/or (b) the axis of the one or more first holes, slots or apertures are inclined at an angle θ2 relative to the axis of the one or more second holes, slots or apertures, wherein θ2 is selected from the group consisting of: (i) 5-20°; (ii) 20-40°; (iii) 40-60°; (iv) 60-80°; (v) 80-100°; (vi) 100-120°; (vii) 120-140°; (viii) 140-160°; (ix) 160-175°; and (x) 90°;

In the first mode of operation ions having opposite polarities but substantially similar mass to charge ratios are preferably simultaneously and/or sequentially ejected from the ion trap via separate, different, discrete or non-overlapping exit paths, pathways or routes.

According to an embodiment in the first mode of operation ions having mass to charge ratios within a first range having a lower limit and an upper limit and ions having mass to charge ratios within a second different range having a lower limit and an upper limit are simultaneously and/or sequentially ejected from the ion trap via separate, different, discrete or non-overlapping exit paths, pathways or routes. Preferably, either: (a) the first range and/or the second range include ions having mass to charge ratios within one or more of the following ranges: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; and (xxi) >1000; and/or (b) the difference between the upper limit of the second range and the upper limit of the first range at an instance in time falls within a range selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; and (xxi) >1000.

According to an embodiment the lower and/or the upper limit of the first range and/or the lower and/or the upper limit of the second range is varied, increased, decreased, stepped or scanned during a scan period. Preferably, during the scan period either: (a) ions having mass to charge ratios within a range x1 are ejected from the ion trap via a first exit path, pathway or route, wherein x1 is selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; and (xxi) >1000; and/or (b) ions having mass to charge ratios within a range x2 are ejected from the ion trap via a second separate, different, discrete or non-overlapping exit path, pathway or route, wherein x2 is selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; and (xxi) >1000.

In the first mode of operation either: (a) ions having mass to charge ratios within a first range and/or ions having a first polarity are arranged and adapted to exit the ion trap solely in a first radial direction; and/or (b) ions having mass to charge ratios within a second different range and/or ions having a second polarity opposite to the first polarity are arranged and adapted to exit the ion trap solely in a second different radial direction; and/or (c) ions having mass to charge ratios within a third different range and/or ions having a third polarity are arranged and adapted to exit the ion trap solely in an axial direction. The third polarity is preferably the same either as the first polarity or the second polarity.

The ion trap preferably further comprises a device arranged and adapted to cause ions having different mass to charge ratios and/or different polarities to be mass selectively ejected from the ion trap.

The ion trap preferably further comprises a device arranged and adapted to eject ions from the ion trap by mass selective instability.

The ion trap preferably further comprises a device arranged and adapted to apply a dipolar excitation waveform to the electrodes in order to eject ions from the ion trap. According to an embodiment the ion trap further comprises: a first auxiliary AC or RF voltage supply for supplying a first auxiliary AC or RF voltage to the electrodes, wherein the first auxiliary AC or RF voltage is arranged, in use, to excite and/or eject ions in a first direction; and a second auxiliary AC or RF voltage supply for supplying a second auxiliary AC or RF voltage to the electrodes, wherein the second auxiliary AC or RF voltage is arranged, in use, to excite and/or eject ions in a second different direction.

The ion trap preferably further comprises a device arranged and adapted to apply a quadrupolar excitation waveform to the electrodes in order to eject ions from the ion trap.

The ion trap preferably further comprises a device arranged and adapted to apply a parametric excitation waveform to the electrodes in order to eject ions from the ion trap.

The ion trap preferably further comprises a device for applying a DC voltage to the electrodes.

The ion trap preferably further comprises AC or RF voltage means for supplying an AC or RF voltage to the electrodes in order to confine ions radially and/or axially within the ion trap. According to the preferred embodiment the AC or RF voltage means is arranged and adapted: (i) to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 25.0-300 V peak to peak; (vii) 300-350 V peak to peak; (viii) 350-400 V peak to peak; (ix) 400-450 V peak to peak; (x) 450-500 V peak to peak; and (xi) >500 V peak to peak; and/or (ii) to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The ion trap preferably further comprises a device arranged and adapted to either:

(a) vary, increase, decrease, step or scan the amplitude of the AC or RF voltage in order to mass selectively eject ions from the ion trap; and/or (b) vary, increase, decrease, step or scan the frequency of the AC or RF voltage in order to mass selectively eject ions from the ion trap; and/or (c) vary, increase, decrease, step or scan one or more dipole excitation voltages applied to the electrodes in order to mass selectively eject ions from the ion trap; and/or (d) vary, increase, decrease, step or scan one or more quadrupolar excitation voltages applied to the electrodes in order to mass selectively eject ions from the ion trap; and/or (e) vary, increase, decrease, step or scan one or more parametric excitation voltages applied to the electrodes in order to mass selectively eject ions from the ion trap; and/or (f) vary, increase, decrease, step or scan one or more DC voltages applied to the electrodes in order to mass selectively eject ions from the ion trap.

According to an embodiment the ion trap may comprise one or more 2D ion traps. The or each 2D ion trap preferably comprises a linear ion trap or a plurality of elongated rods or electrodes. The or each 2D ion trap preferably comprises at least 4, 6, 8 or 10 elongated rods or electrodes. One or more holes, slots or apertures are preferably provided in at least some or all of the elongated rods or electrodes. Ions preferably exit the ion trap via the one or more holes, slots or apertures. According to an embodiment at least 2, 3, 4, 5, 6, 7, 8, 9 or 10 2D ion traps may be arranged in series.

According to another embodiment the ion trap may comprise one or more 3D ion traps. The or each 3D ion trap preferably comprises at least one central ring electrode. According to the preferred embodiment the central ring electrode of the or each 3D ion trap is radially segmented or comprises at least 2, 3, 4, 5, 6, 7, 8, 9 or 10 radial segments. One or more holes, slots or apertures are preferably provided in at least some or all of the radial segments. Ions preferably exit the ion trap via the one or more holes, slots or apertures. An embodiment is contemplated wherein at least 2, 3, 4, 5, 6, 7, 8, 9 or 10 3D ion traps are arranged in series.

Other embodiments are contemplated wherein at least 1, 2, 3, 4, 5, 6, 7, 8, 9, or 10 2D ion traps, and at least 1, 2, 3, 4, 5, 6, 7, 8, 9 or 10 3D ion traps are arranged in series.

According to an embodiment the ion trap may comprise a plurality of ion traps arranged in a linear geometry, a closed-loop geometry, an open-loop geometry or a folded geometry.

The ion trap preferably comprises: one or more entrance and/or exit electrodes; and a device for applying a DC and/or an AC or RF voltage to the one or more entrance and/or exit electrodes in order to confine ions axially within the ion trap.

According to another aspect of the present invention there is provided a mass spectrometer comprising an ion trap as described above.

The mass spectrometer preferably further comprises one or more first ion detectors arranged to detect ions which exit the ion trap via a first exit path, pathway or route and one or more second separate ion detectors arranged to detect ions which exit the ion trap via a second different separate exit path, pathway or route.

The mass spectrometer preferably further comprises either:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; and/or (b) an ion mobility spectrometer or separator and/or a Field Asymmetric Ion Mobility Spectrometer device arranged upstream and/or downstream of the ion trap; and/or (c) a further ion trap or ion trapping region arranged upstream and/or downstream of the ion trap; and/or (d) a collision, fragmentation or reaction device arranged upstream and/or downstream of the ion trap, wherein the collision, fragmentation or reaction device is selected from the group consisting of: (i) a Collisional Induced Dissociation ("CID") fragmentation device; (ii) a Surface Induced Dissociation ("SID") fragmentation device; (iii) an Electroon Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions; and/or (e) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

According to another aspect of the present invention there is provided a method of trapping ions comprising:

providing an ion trap comprising a plurality of electrodes;

applying one or more voltages to the electrodes so that ions having substantially different mass to charge ratios and/or opposite polarities are simultaneously ejected from the ion trap via separate, different, discrete or non-overlapping exit paths, pathways or routes.

According to another aspect of the present invention there is provided a method of mass spectrometry comprising a method as described above.

According to another aspect of the present invention there is provided a 3D ion trap comprising:

a central ring electrode comprising a plurality of radial segments wherein one or more of the radial segments have a slot, hole or aperture through which ions are ejected in use.

The 3D ion trap preferably further comprises one or more end-cap electrodes wherein ions having a first mass to charge ratio and/or a first polarity are arranged and adapted to exit the ion trap solely via a first exit path, pathway or route which passes through one or more first holes, slots or apertures in the central ring electrode. Ions having a second different mass to charge ratio and/or a second opposite polarity are preferably arranged and adapted to exit the ion trap solely via a second different exit path, pathway or route which preferably passes through one or more second different holes, slots or apertures in the central ring electrode.

According to another aspect of the present invention there is provided a method of trapping ions comprising:

providing a 3D ion trap comprising a central ring electrode having a plurality of radial segments, wherein one or more of the radial segments have a slot, hole or aperture; and ejecting ions through the slot, hole or aperture.

The method preferably further comprises:

providing one or more end-cap electrodes;

ejecting ions having a first mass to charge ratio and/or a first, polarity from the ion trap solely via a first exit path, pathway or route which passes through one or more first holes, slots or apertures in the central ring electrode; and ejecting ions having a second different mass to charge ratio and/or a second opposite polarity from the ion trap solely via a second different exit path, pathway or route which passes through one or more second different holes, slots or apertures in the central ring electrode.

The preferred embodiment relates to the simultaneous mass selective ejection of ions having differing mass to charge ratios from an ion trap via different, separate or discrete exit paths. The ions which are ejected may be transferred to separate devices for further analysis or may be directed onto one of a plurality of separate ion detectors which may be situated external to the ion trap.

According to an embodiment ions may be mass selectively ejected from the ion trap through two or more holes or slots which are preferably provided in two or more of the electrodes which preferably form part of the ion trap.

The mass selective ejection of ions from the ion trap may be achieved by dipolar or quadrupolar excitation or by mass selective instability.

Mass selective ejection of ions may be achieved with or without applying an additional DC voltage to one or more of the electrodes comprising the ion trap.

In the case of dipolar excitation, multiple supplementary alternating potentials are preferably applied to the electrodes comprising the ion trap. Each supplementary AC potential is preferably arranged to excite and eject ions in a particular direction within the ion trap. The frequency of each supplementary AC potential is preferably set to coincide with the frequency of oscillation of the ions to be ejected in the particular direction or location in which the dipole excitation is applied.

In the case of quadrupolar excitation, a supplementary AC potential may be applied to two or more electrodes comprising the ion trap.

Additional DC potentials differences may be applied between two or more of the ion trap electrodes in order to alter the characteristic frequency at which ions oscillate within the quadrupolar confining field developed within the ion trap.

According to an embodiment two or more fixed excitation frequencies may be applied simultaneously. This preferably results in the simultaneous ejection of ions having at least two different mass to charge ratios via at least two different or separate exit routes or pathways.

The preferred embodiment also allows at least two different mass selective ejections scans, covering at least two different mass to charge ratio ranges, to be performed simultaneously. Ions from each mass to charge ratio range may be detected using separate detedtors and associated electronics.

Simultaneous ejection of ions having multiple mass to charge ratios from the preferred ion trap allows analysis times to be decreased without decreasing the time for ejection of ions at each mass to charge ratio and therefore without compromising the mass resolution of the ion trap. This is of particular value when the composition of ions entering the ion trap is varying rapidly. Alternatively, if the total time to analyse all the ions of interest in the ion trap is fixed, then simultaneous ejection of ions having different mass to charge ratios in different directions allows the time for ejection of ions of each mass to charge ratio to be extended thereby improving overall mass resolution.

According to an embodiment a buffer gas may be introduced within the ion trap in order to cool ions by collisions.

The preferred embodiment also enables positive and negative ions within the ion trap to be mass selectively ejected and detected separately thereby enabling separate mass spectra corresponding to ions having only one polarity to be produced.

BRIEF DESCRIPTION OF THE DRAWINGS

Various embodiments of the present invention will now be described, by way of example only, and with reference to the accompanying drawings in which:

FIG. 12 shows a cross-sectional view through a three-dimensional ion trap in the x,y plane according to an embodiment of the present invention;

DETAILED DESCRIPTION OF THE PREFERRED EMBODIMENTS

An ion trap 1 according to a preferred embodiment of the present, invention will now be described with reference to FIG. 1. The ion trap 1 is shown in the y,z plane and preferably comprises an elongated quadrupole rod set 1. Ions are preferably confined axially within the ion trap 1 by applying either a DC voltage or an RF voltage to two end electrodes 2 which are preferably arranged at the entrance and exit of the ion trap 1. Alternatively, a combination of both DC and RF voltages may be applied to one or more of the end electrodes 2 in order to provide an axial potential and/or a pseudo-potential barrier at the entrance and/or exit of the ion trap 1.

Figure 1:
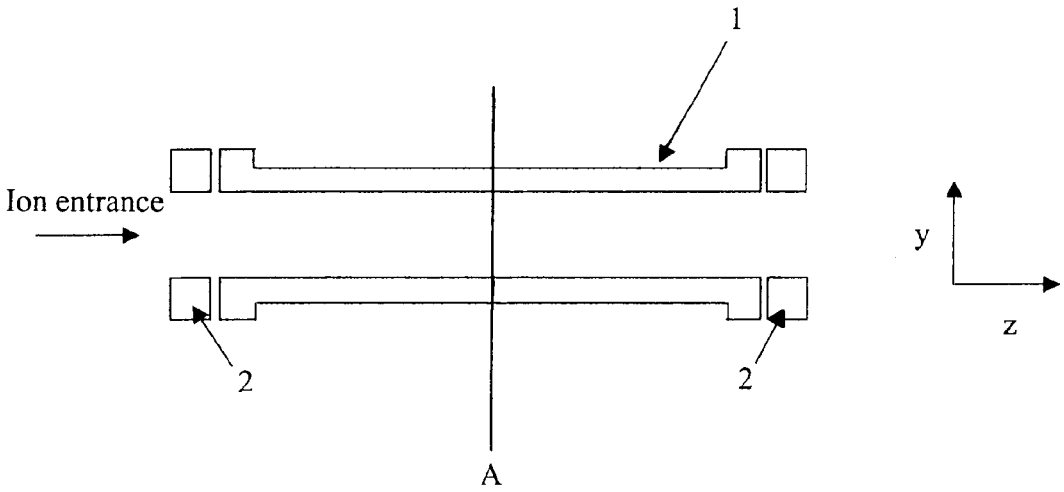
FIG. 1 shows an ion trap according to a preferred embodiment in the y,z plane.
Figure 2:
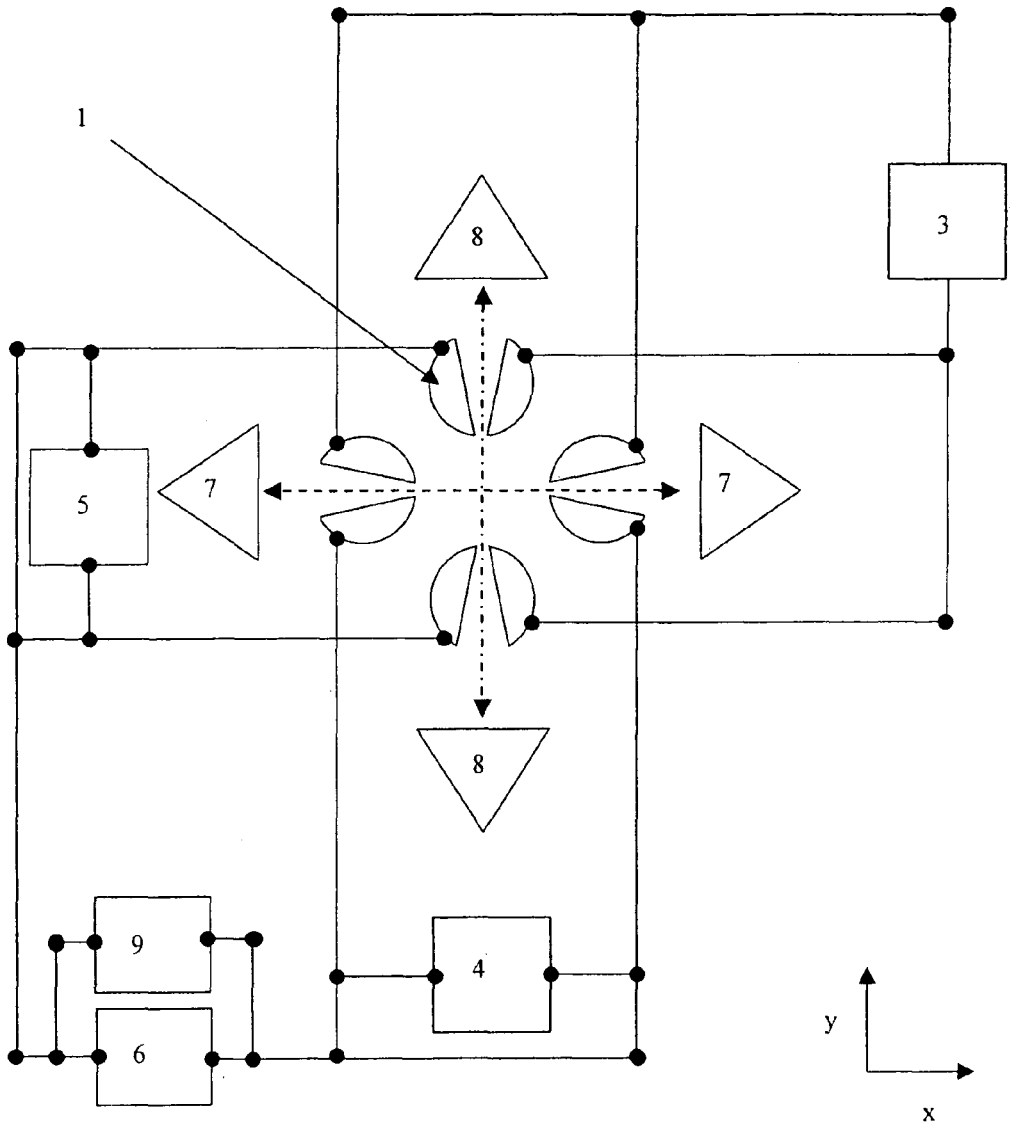
FIG. 2 shows an ion trap according to a preferred embodiment in the x,y plane.

FIG. 2 shows a schematic of the preferred ion trap 1 in the x,y plane in cross-section along line 'A' as shown in FIG. 1. Ions are preferably confined radially within the ion trap 1 by applying an AC or RF potential to opposing pairs of electrodes. The AC or RF potential is preferably supplied by an AC or RF voltage supply 3. A first auxiliary oscillating dipole voltage is preferably supplied by a first auxiliary AC or RF voltage supply 4 between a first set of electrodes. First ion detectors 7 are preferably positioned to detect ions which are ejected through slots in two of the electrodes due to ions being ejected by the application of the first auxiliary AC or RF voltage.

A second separate auxiliary oscillating dipole voltage is preferably supplied by a second auxiliary AC or RF voltage supply 5 between a second set of electrodes. Second ion detectors 8 are preferably positioned to detect ions which are ejected through slots in two of the electrodes due to ions being ejected by the application of the second auxiliary AC or RF voltage.

A DC potential may optionally be maintained between both pairs of electrodes by supplying a DC voltage from a DC voltage supply 6. The application of a DC voltage allows the frequency of oscillation and the conditions for stability of ions trapped within the ion trap 1 to be modified or otherwise varied.

An optional quadrupolar excitation supply 9 is also preferably provided. A quadrupolar excitation voltage may be applied to the electrodes in order to mass selectively eject ions according to another embodiment of the present invention.

Ions are preferably arranged to enter the ion trap 1 along the central axis of the ion trap 1. Ions are preferably trapped within the ion trap 1 after an accumulation period by applying appropriate potentials to the end electrodes 2. Buffer gas may be introduced into the ion trap 1 in order to cool ions by collisions.

According to an embodiment auxiliary oscillating dipolar excitation potentials may be applied in the x and the y directions using the first auxiliary AC or RF voltage supply 4 and the second auxiliary AC or RF voltage supply 5. The fundamental frequency of ion oscillation or secular frequency ω is given by the approximation in Eqn. 1 below:

$$\omega_u = \frac{\beta_u \cdot \Omega}{2} \tag{1}$$

where:

$$\beta_u = \sqrt{a_u + \frac{q_u^2}{2}} \tag{2}$$

and $$a_u = a_x = -a_y = \frac{4eU}{m\Omega^2 r_0^2} \tag{3}$$

$$q_u = q_x = -q_y = \frac{2eV}{m\Omega^2 r_0^2} \tag{4}$$

wherein e is electron charge, m is mass, Ω the frequency of the confining RF, V is the pk-pk voltage of the confining RF, $r_0$ is the internal radius of the electrode structure and
U is the amplitude of the DC voltage applied between pairs of rods.

When no additional DC voltage is applied via the DC supply 6 then the expression for the secular frequency can be simplified to:

$$\omega_u = k \cdot \frac{V}{m} \tag{5}$$

Where:

$$k = \frac{e}{\sqrt{2} \cdot \Omega \cdot r_0^2} \tag{6}$$

Figure 3:
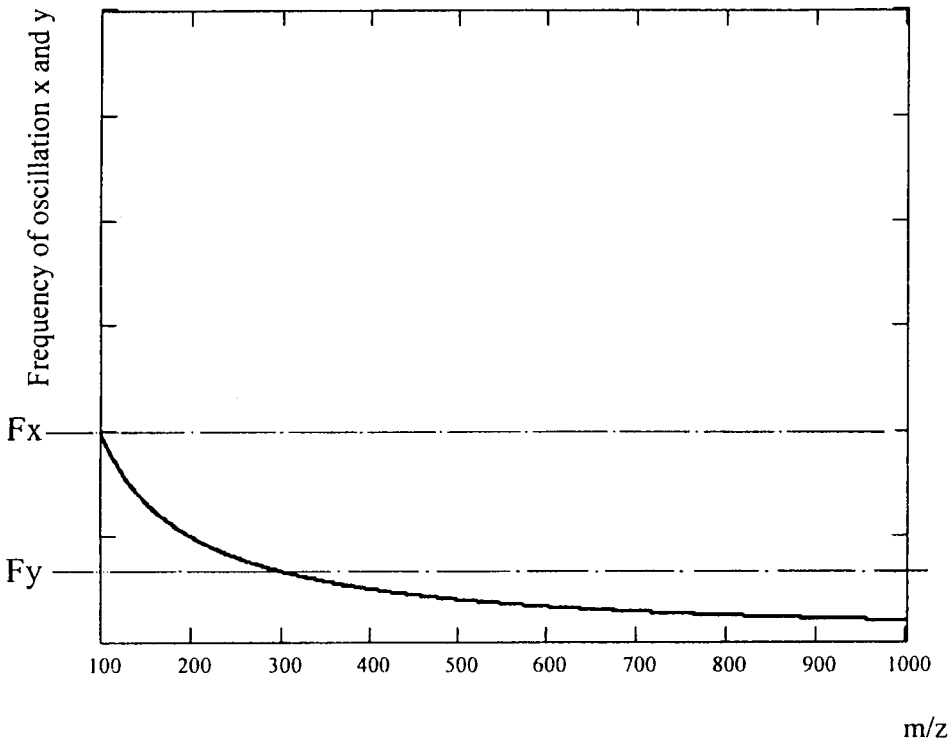
FIG. 3 shows a plot of the oscillation frequency for ion motion in the x and y directions versus mass to charge ratio at the start of an analytical scan.

FIG. 3 shows a graph of the frequency of oscillation ω of ions in the radial pseudo-potential well in both the x and y directions as a function of mass to charge ratio for a constant value of RF amplitude V and frequency Ω.

According to an embodiment, at time T0 a dipole excitation voltage having a frequency $F_x$ is preferably applied in the x direction via the first auxiliary AC or RF voltage supply 4. In the example shown in FIG. 3, this corresponds to exciting ions having a mass to charge ratio of approximately 100. At the same time T0 a dipole excitation voltage having a frequency $F_y$ is preferably applied in the y direction via the second auxiliary AC or RF voltage supply 5. In the example shown in FIG. 3, this corresponds to exciting ions having a mass to charge ratio of approximately 300. The main confining RF amplitude V is then preferably increased up or scanned to a maximum value at time T1 wherein T1>T0.

Figure 4:
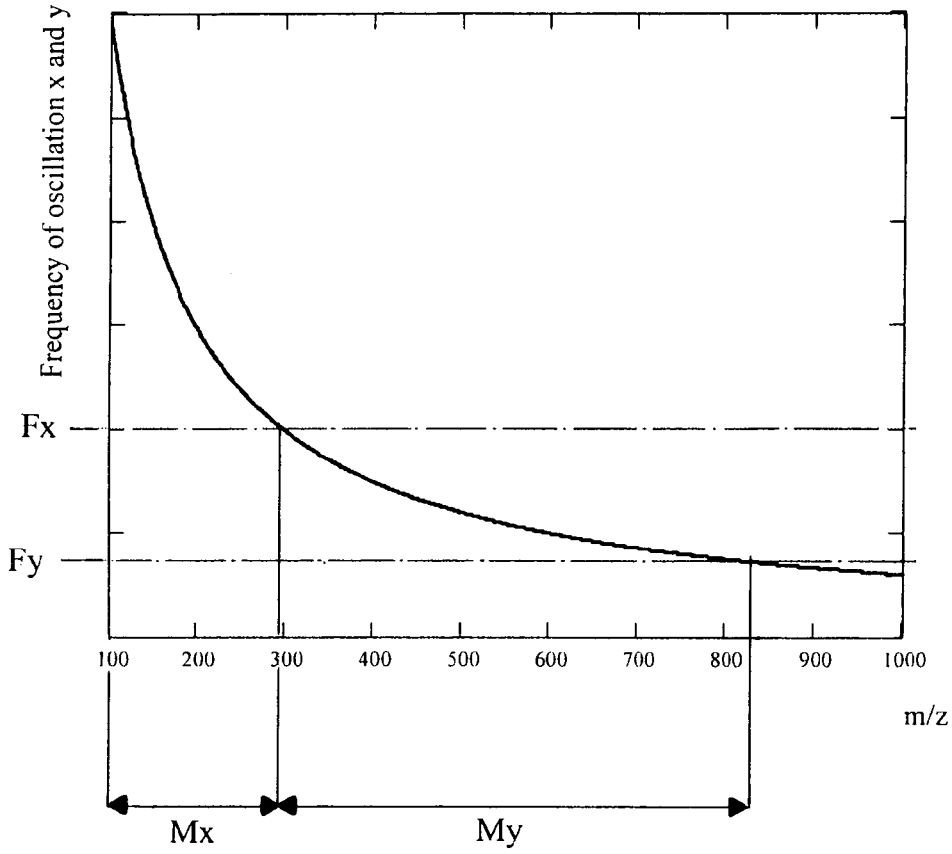
FIG. 4 shows a plot of the oscillation frequency for ion motion in the x and y directions versus mass to charge ratio at the end of an analytical scan.

FIG. 4 shows a plot of secular frequency ω versus mass to charge ratio at the subsequent time T1 i.e. at the end of the analytical scan. During the previous time period from T0 to T1 ions having mass to charge ratios in the approximate range $M_x$=100-300 will have been sequentially ejected in the x direction and will have been detected by the first ion detectors 7. During the same time period from T0 to T1 ions having mass to charge ratios in the approximate range $M_y$=300-830 will have been sequentially ejected in the y direction and will have been detected by the second ion detectors 8. It is apparent from FIG. 2 that ions having mass to charge ratios in the range 100-300 will exit the ion trap via a first exit path which is arranged along the x-direction. Ions having mass to charge ratios in the range 300-830 will exit the ion trap via a second separate and discrete exit path which is arranged along the y-direction.

Analytical scans involving different mass to charge ratio ranges and different scan directions are contemplated. Furthermore, in addition to or instead of scanning the magnitude of the confining RF voltage V, analytical scans are also contemplated wherein the frequency ω of the dipole excitation voltages and/or the RF frequency Ω are scanned.

According to an embodiment the two dipole excitation frequencies $F_x$ and $F_y$ may be set to eject ions simultaneously having two different mass to charge ratios from a population of ions present within the ion trap 1. In this mode of operation instead of scanning the confining RF amplitude or dipole excitation frequencies, the RF amplitude or dipole excitation frequencies may be stepped or switched. For each step, ions having two different mass to charge ratios will be ejected and detected simultaneously using two different detectors or pairs of detectors.

If a DC voltage is additionally applied between the rods of the quadrupole ion trap 1 using the DC voltage supply 6 as shown in FIG. 2, then the secular frequency will be modified as detailed above in Eqns. 1 and 2. The application of a positive DC voltage to the rods in the x direction with respect to the y direction will result in an increase in the fundamental frequency for positive ions in the x direction and a simultaneous decrease in the frequency of oscillation for positive ions having the same mass to charge ratio in the y direction. To a first approximation, this may be envisaged as the superposition of the confining pseudo-potential well and the DC saddle field due to the applied DC potential. The pseudo-potential well acts equally on ions of the same mass to charge ratio regardless of the polarity of the ions. The DC saddle field will act to drive ions towards the centre of the ion trap only in one direction, x or y. Ions will simultaneously experience a driving force away from the centre in the opposite direction, y or x. For the same polarity of DC voltage applied in the x or y direction, the direction of the confining or ejecting force, arising from application of the DC voltage will depend on the polarity of the ion.

The frequency of oscillation of an ion in the x and y directions in the combined RF and DC field can be approximated by Eqns. 7 and 8:

$$\omega_x = \sqrt{B \cdot \frac{V^2}{m^2} - p \cdot A \cdot \frac{U_y}{m}} \tag{7}$$

$$\omega_y = \sqrt{B \cdot \frac{V^2}{m^2} - p \cdot A \cdot \frac{U_x}{m}} \tag{8}$$

Where:

$$B = \frac{e^2}{\Omega^2 \cdot r_0^4} \tag{9}$$

$$A = \frac{e}{r_0^2} \tag{10}$$

wherein p is the polarity of the ion and is either +1 or −1.

It should be noted that application of a DC voltage will reduce the range of masses which are stable within the ion trap 1.

Analytical scans similar to those described but without application of a DC voltage are envisaged wherein the dipolar excitation frequency in the x and the y direction matches the frequency of oscillation in the combined RF and DC field.

In addition, the application of a DC voltage allows simultaneous ejection and detection of ions having the same or substantially the same mass to charge ratios but having opposite polarities. Positive ions and negative ions are preferably ejected via different or separate exit pathways. This aspect of the preferred embodiment is particularly advantageous if both positive and negative ions or products of a specific ion-ion interaction experiment are desired to be recorded within a relatively short time frame.

Figure 5:
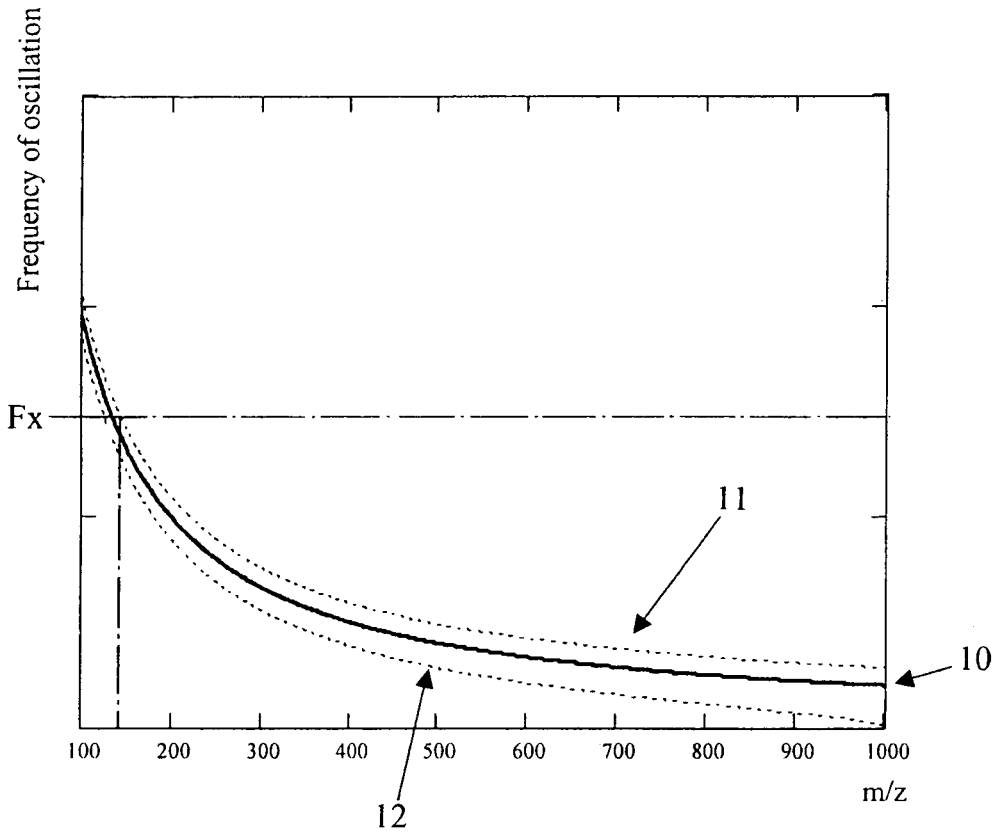
FIG. 5 shows a plot of the oscillation frequency for ion motion in the x direction versus mass to charge ratio at the start of an analytical scan for both positive and negative ions with and without a DC voltage being applied to the electrodes.

FIG. 5 shows a plot of secular frequency ω versus mass to charge ratio for ion motion in the x direction at time T0 according to an embodiment. Curve 10 shows the frequency of both positive and negative ions when no additional DC voltage is applied. Curve 11 shows a shift to higher secular frequency for positive ions in the x direction when a positive DC is applied to the electrodes in the x direction. Curve 12 shows a shift to lower secular frequency for negative ions in the x direction when a positive DC is applied to the electrodes in the x direction.

A dipole excitation frequency $F_x$ is preferably applied between electrodes in the x plane at an initial time T0. In the example shown in FIG. 5, this corresponds to ions having a mass to charge ratio of approximately 140 for a positively charged ion. At the same time T0, a dipole excitation voltage having a frequency $F_y$ (wherein $F_x=F_Y$) is also preferably applied in the y direction.

Figure 6:
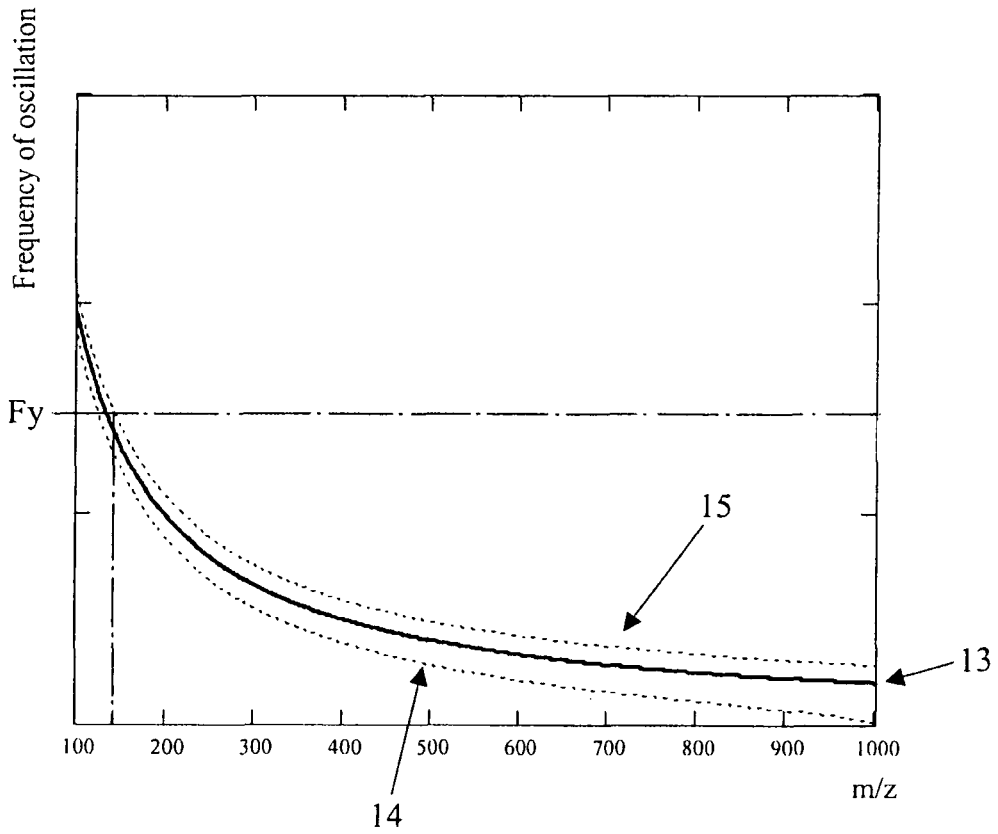
FIG. 6 shows a plot of oscillation frequency for ion motion in the y direction versus mass to charge ratio at the start of an analytical scan for both positive and negative ions with and without a DC voltage being applied to the electrodes.

FIG. 6 shows a plot of secular frequency ω versus mass to charge ratio for ion motion in the y direction at time T0 i.e. at the start of an analytical scan. Curve 13 shows the frequency of both positive and negative ions when no additional DC voltage is applied. Curve 14 shows the shift to lower secular frequency for positive ions in the y direction when a positive DC voltage is applied to the electrodes in the x direction. Curve 15 shows the shift to higher secular frequency for negative ions in the y direction when a positive DC voltage is applied to the electrodes in the x direction.

The initial confining RF amplitude $V_1$ is then preferably increased up or scanned to a maximum value $V_2$ at a subsequent time T1 wherein T1>T0. The magnitude $U_1$ of the applied DC voltage is also preferably increased up to a maximum $U_2$ such that the proportionality given in Eqn. 11 below is preferably maintained throughout the analytic scan:

$$\frac{V_1}{V_2} \propto \sqrt{\frac{U_1}{U_2}} \tag{11}$$

Figure 7:
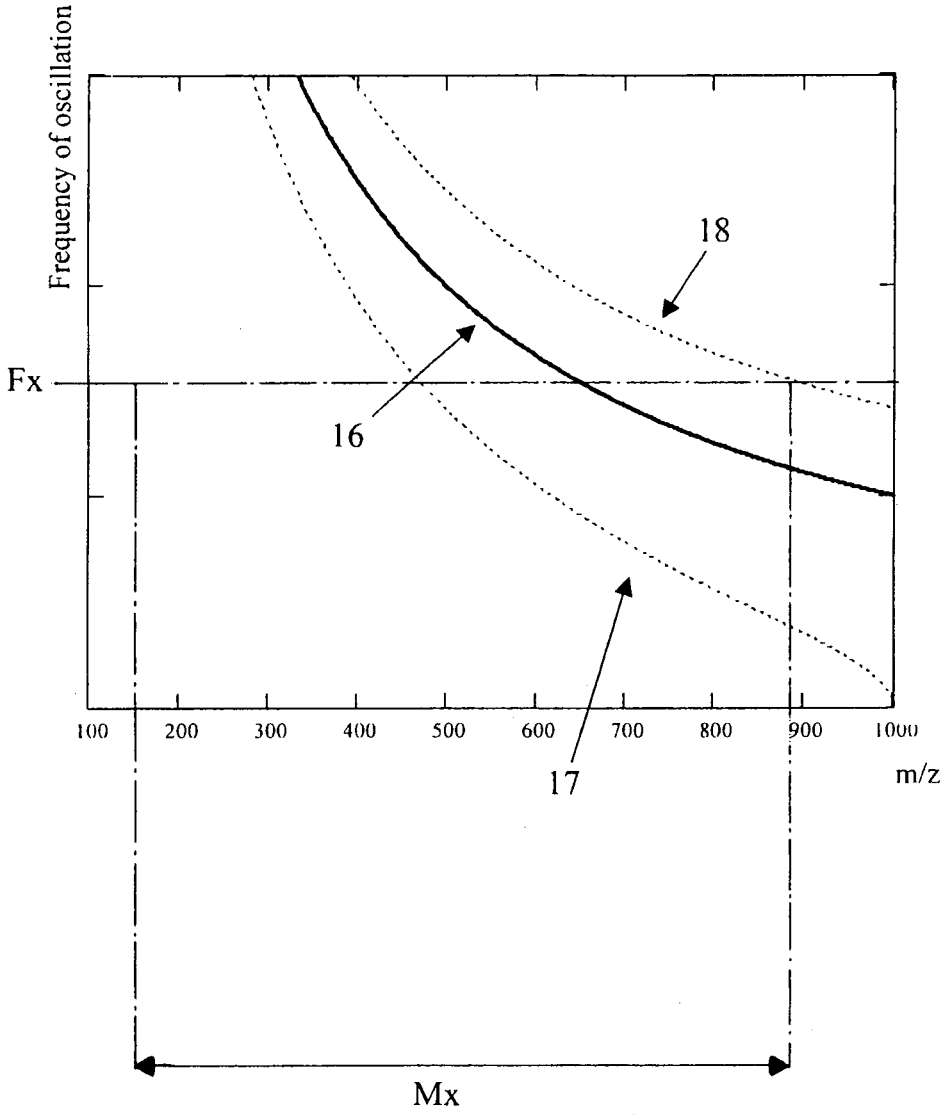
FIG. 7 shows a plot of oscillation frequency for ion motion in the x direction versus mass to charge ratio at the end of an analytical scan for both positive and negative ions with and without a DC voltage being applied to the electrodes.

FIG. 7 shows a plot of secular frequency ω versus mass to charge ratio for ion motion in the x direction at time T1 i.e. at the end of the analytical scan. During the previous time period from T0 to T1, positive ions having mass to charge ratios in the approximate range $M_x$=140-890 were preferably sequentially ejected in the x direction and were preferably detected.

Figure 8:
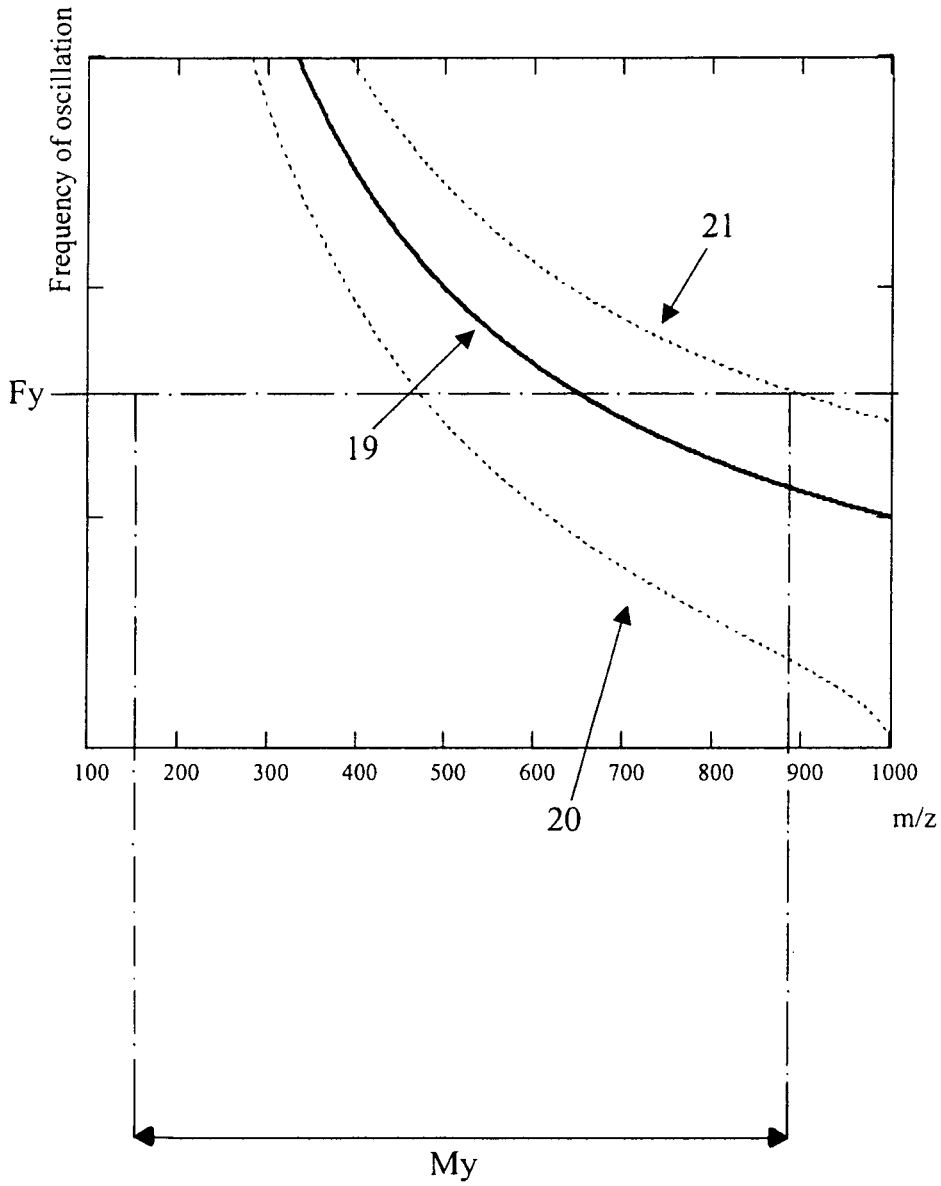
FIG. 8 shows a plot of oscillation frequency for ion motion in the y direction versus mass to charge ratio at the end of an analytical scan for both positive and negative ions with and without a DC voltage being applied to the electrodes.

FIG. 8 shows a plot of secular frequency ω versus mass to charge ratio for ion motion in the y direction at time T1 i.e. at the end of the analytical scan. During the previous time period from T0 to T1, negative ions having mass to charge ratios in the approximate range $M_y$=140-890 were preferably sequentially ejected in the y direction and were preferably detected.

It is apparent, therefore, that according to this embodiment positive ions having mass to charge ratios in the range 140-890 exit the ion trap via a first exit path which is arranged along the x-direction. Negative ions having mass to charge ratios in the range 140-890 exit the ion trap via a second orthogonal exit path which is arranged along the y-direction i.e. in an orthogonal direction.

Analytical scans involving different mass to charge ratio ranges and different scan directions are contemplated according to other embodiments of the present invention. For example, in addition to, or instead of, scanning the magnitude of the confining RF voltage, analytical scans involving scanning the frequency of the dipole excitation voltages and/or the frequency of the confining RF voltage are contemplated.

In addition to ejecting ions by application of dipolar excitation potentials, other embodiments are contemplated wherein simultaneous ejection may be accomplished using quadrupolar or parametric excitation. With reference to FIG. 2, a quadrupolar excitation supply 9 is preferably provided wherein a quadrupolar excitation signal may be applied across both pairs of rods as shown. With no DC potential applied via the DC voltage supply 6, ions are preferably excited in both x and y directions simultaneously and cannot be directed through slots in the rods to either the first or second detectors 7,8. However, if a DC voltage is applied then the secular frequency for ions having the same mass to charge ratio in the x and the y directions becomes different. This allows ions having a specific mass to charge ratio or ions having mass to charge ratios within a certain range to be simultaneously ejected in the x and the y directions. Similar analytical scans to those already described are contemplated.

Parametric excitation includes applying an excitation signal at, for example, twice the frequency of the secular frequency of ion oscillation. Therefore, ions undergo an increased number of resonance cycles before being ejected compared to dipole excitation for the same time duration of excitation. Accordingly, quadrupolar excitation enables improvements in mass resolution to be obtained compared to using dipolar excitation to eject ions.

Figure 9:
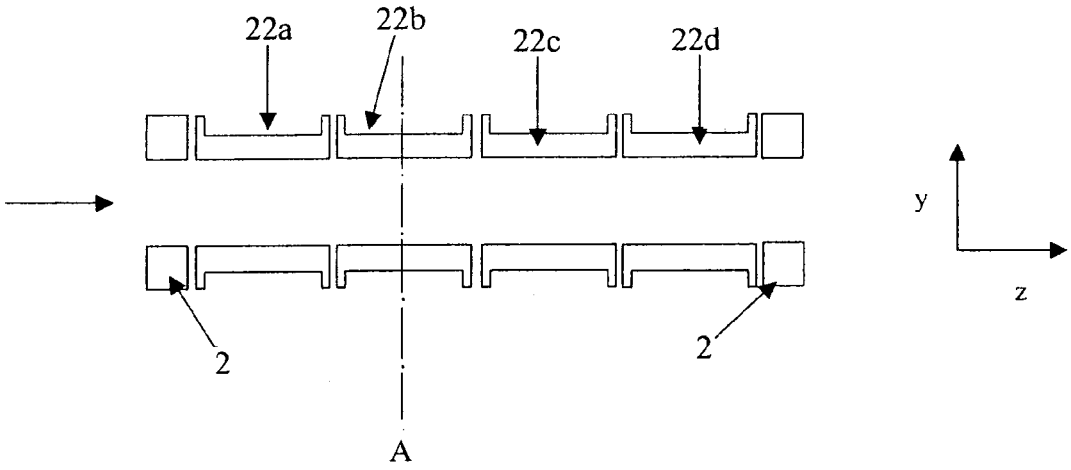
FIG. 9 shows an ion trap according to another embodiment of the present invention wherein, the ion trap comprises a plurality of axial segments.

An ion trap according to another embodiment of the present invention is shown in FIG. 9. According to this embodiment, a quadrupole ion trap is preferably provided which comprises two or more axial segments. In the particular example shown in FIG. 9 an ion trap 1 is provided comprising four axial segments 22*a*,22*b*,22*c*,22*d*. However, other embodiments are contemplated wherein n axial segments may be provided and wherein n>1. Each axial segment is preferably configured as described above with reference to the embodiment shown and described with reference to FIG. 2. Each axial segment may be supplied with independently controlled excitation electronics allowing ejection of ions having different mass to charge ratios from each segment.

Ions are preferably confined within the ion trap by applying voltages to two end electrodes 2 which are preferably arranged at the entrance and exit regions of the ion trap in a manner substantially as described above.

Mass selective ejection of ions preferably occurs through one or more holes or slots in one or more electrodes which form the ion trap.

Simultaneous mass selective ejection may be achieved from one or more of the segments in either the x or the y direction or simultaneously in both x and y directions using dipolar or quadrupolar excitation or by mass selective instability.

Mass selective ejection may be achieved with or without an additional DC voltage being applied to one or more of the electrodes comprising one or more of the segments of the ion trap.

The amplitude and the frequency of the confining RF potential applied to the electrodes forming each individual segment is preferably maintained the same. However, the amplitude and the frequency of the confining RF potential may be changed independent for each segment to allow alternative analytical scans to be performed within each segment and to allow manipulation of ion populations between segments.

Figure 10:
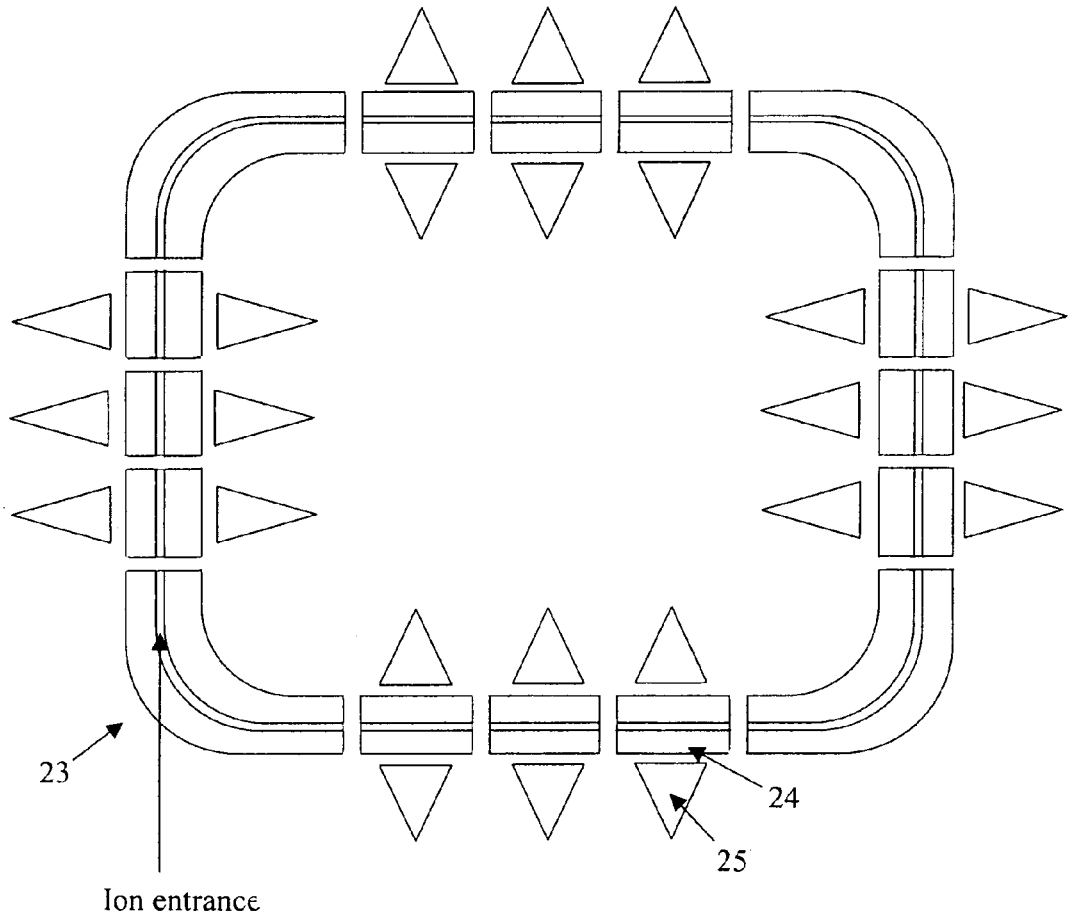
FIG. 10 shows an ion trap according to another embodiment of the present invention wherein an ion trap is provided comprising a plurality of ion trap segments arranged in a loop.

Other embodiments are contemplated wherein the segmented linear quadrupole geometry may be formed into a circle, ellipse or racetrack type ion trap structure. FIG. 10 shows a schematic diagram of a racetrack type quadrupole ion trap arrangement according to an embodiment of the present invention. Each individual segment of the ion trap is preferably arranged as described above in relation to FIG. 2. Ions are preferably arranged to enter the ion trap along the central axis at an initial time T0. At the initial time T0 no RF confining voltage is preferably applied to a segment 23 of the ion trap which acts as an entrance to the ion trap. Once ions have entered the ion trap then a confining RF potential is preferably applied to the segment 23.

Portions of the electrode structure which are curved may exhibit non-linearity in the radial field which may affect the performance of axial mass selective ejection. However, portions of the ion trap which are not curved will comprise suitable radial fields for optimal performance. The linear portions of the ion trap are preferably axially segmented 24 as shown in FIG. 10 and may be supplied with individual excitation electronics and ion detectors 25. Simultaneous mass selective ejection in the x and y directions may be performed at one or more segments of the ion trap in a manner as described above.

Other embodiments are contemplated wherein a circular ion trap may be constructed having a folded quadrupole geometry. The shape of the internal electrode surface may be modified to maintain a substantially quadratic radial field as is preferably required for best analytical performance.

Figure 11:
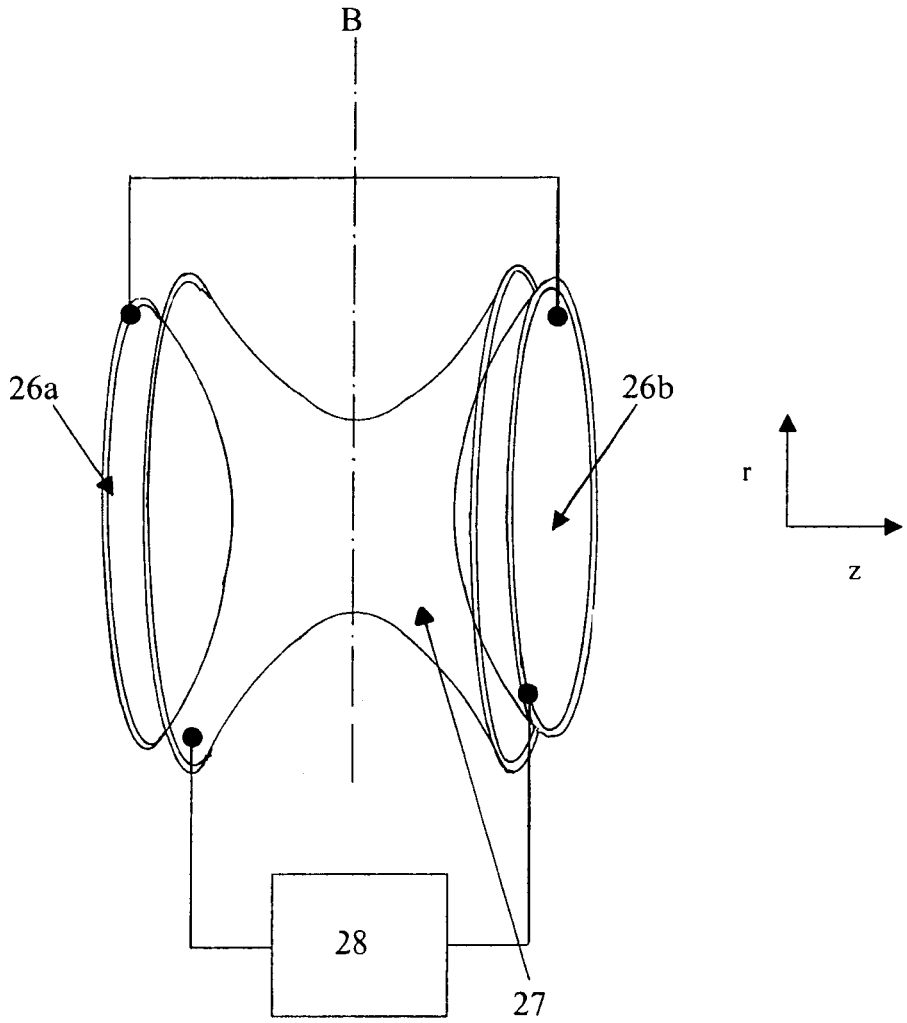
FIG. 11 PRIOR ART
FIG. 11 shows a conventional three-dimensional ion trap.

According to another embodiment, an ion trap may be provided which comprises a three-dimensional rotationally symmetric or elliptical ion trap. The 3D ion trap preferably comprises a central ring electrode which is preferably segmented into two or more segments to allow simultaneous excitation and mass selective ejection of ions having differing mass to charge ratios to separate ion detectors. FIG. 11 shows the electrode structure of a conventional rotationally symmetric three-dimensional ion trap. The conventional ion trap comprises two end cap electrodes 26*a*,26*b* having hyperbolic surface profiles and a central ring electrode 27 having a hyperbolic surface profile. A confining RF voltage is applied between the central ring electrode 27 and the two end cap electrodes 26*a*,26*b*. The potential within the trapping volume is substantially quadratic. Ions confined within the trapping volume undergo a secular oscillation frequency in proportion to their mass to charge ratio. Depending on the geometry of the trapping electrodes the frequency of ion oscillation in the radial direction r may be different from the frequency of ion oscillation in the z direction. Ions having a specific mass to charge ratio may be excited in the z direction by application of a suitable dipolar excitation voltage across the end cap electrodes 26*a*,26*b*. Ions exit the ion trap via a hole in the end cap electrodes 26*a*,26*b* and are then detected by the ion detector.

FIG. 12 shows a schematic of a three-dimensional ion trap according to a preferred embodiment of the present invention. The preferred ion trap is shown in the x,y plane in cross-section along line B as shown in FIG. 11. According to the preferred embodiment, the central ring electrode is preferably segmented into four segments 29*a*,29*b*,29*c*,29*d*. Each segment 29*a*,29*b*,29*c*,29*d* preferably comprises a central or radial exit passageway which preferably leads to an ion detector 30; 31. A confining RF voltage 32 is preferably applied to each of the four segments 29*a*,29*b*,29*c*,29*d* and is preferably maintained at the same amplitude and frequency. Ions may be excited in either the x or the y directions by application of a supplementary dipolar excitation voltage using either first voltage supply 33 and/or second voltage supply 34. Ions which are ejected through slots in the individual segments are preferably detected by one of the ion detectors 30,31. Ions may also be ejected simultaneously in the z direction by applying a separate dipolar excitation voltage between the two end cap electrodes. A separate detector may be positioned to record the arrival of these ions. In this example, ions having up to three different mass to charge ratios or ions having mass to charge ratios with three different ranges may be ejected simultaneously and via separate exit pathways.

Other embodiments are contemplated wherein the central ring electrode may be split into more than four segments and each pair of opposing segments may be supplied with a separate dipole excitation supply. Ion detectors may be provided for each segment to allow even greater parallelism of ion ejection.

Figure 13:
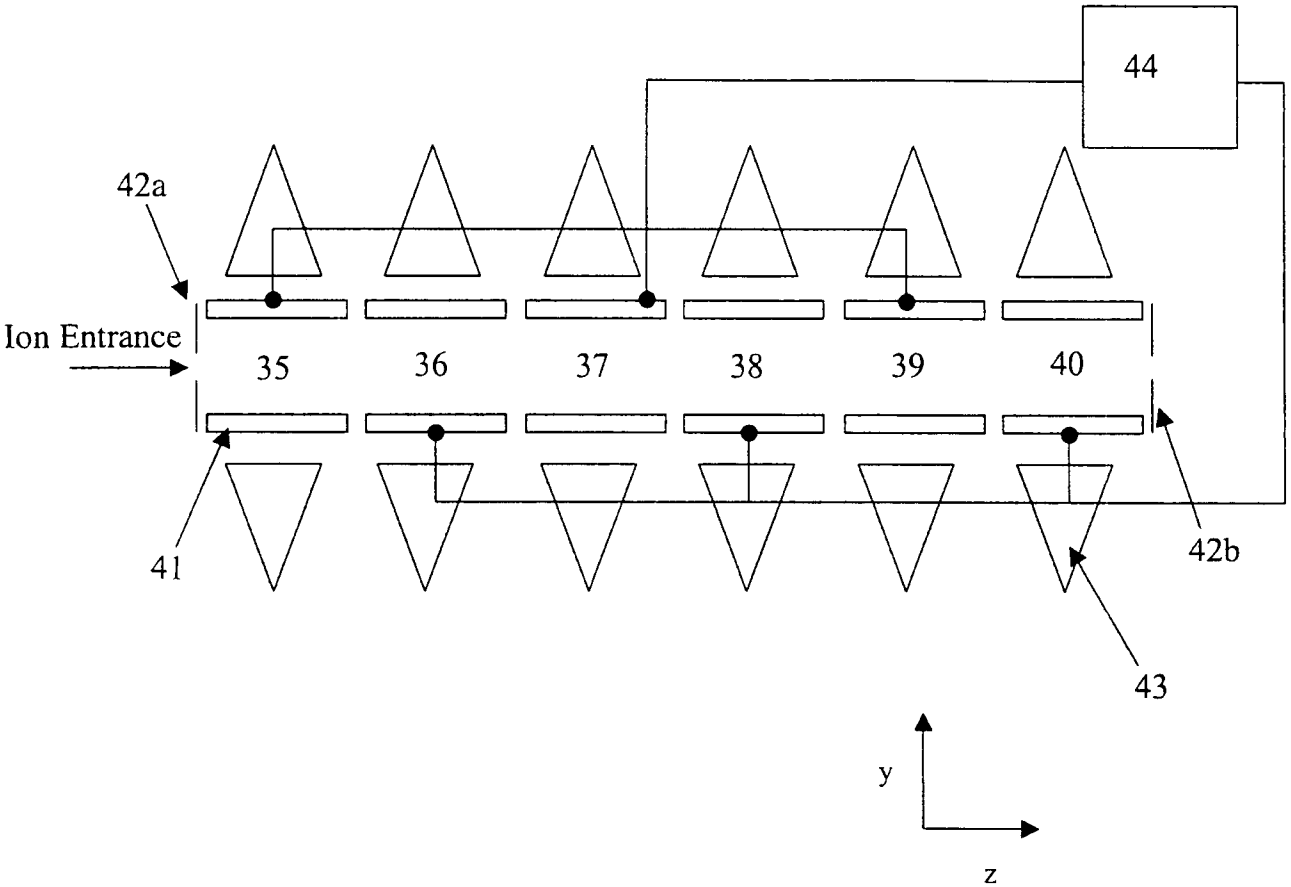
FIG. 13 shows a cross-sectional view of an array of three-dimensional ion traps arranged in the y,z plane according to an embodiment the present invention.

According to another embodiment an ion trap may be provided comprising an array or series of three-dimensional rotationally symmetric or elliptical ion traps. FIG. 13 shows a schematic of such an embodiment in the y,z plane. The ring electrodes of each of the three-dimensional ion traps are preferably segmented into two or more segments to allow simultaneous excitation and mass selective ejection of ions having differing mass to charge ratios to separate detectors. The overall ion trap preferably comprises a series of segmented ring electrodes 41 and is preferably bounded by two end electrodes 42*a*,42*b*. In the example shown in FIG. 13 an array of six individual ion traps 35-40 is shown. Other embodiments are contemplated wherein n ion traps may be provided and wherein n>1.

The ring electrode 41 of each of the 3D ion traps 35-40 is preferably configured as described above with reference to FIG. 12. Multiple radial ion detectors 43 may be provided in one plane and/or multiple radial detectors (not shown) may be provided in the orthogonal plane for at least some and preferably all of the ring electrodes 41. Opposite phases of an AC or RF voltage are preferably applied to adjacent ring electrodes using an AC or RF voltage supply 44. Each ion-trapping region is preferably bounded by a ring electrode, in the radial direction and by zero potential planes or virtual boundaries between adjacent ring electrodes in the axial or z direction. Two end electrodes 42*a*,42*b* preferably form real zero potential boundaries for the ion traps at the beginning or entrance to the array and/or at the end or exit of the array. The surface profile of the ring electrodes may be shaped to maintain an approximately quadratic pseudo-potential well in both the radial and axial directions.

Ions having differing mass to charge ratios or ions having mass to charge ratios within different scan ranges may be ejected simultaneously through different slots in the ring electrodes 41 in a manner according to the preferred embodiment as described above.

Further embodiments are contemplated wherein each ring electrode 41 may be split into more segments and each pair of opposing segments may be supplied with a separate dipole excitation supply and ion detector to allow even greater parallelism of ion ejection.

In addition, ions within the array may be excited or ejected axially by application of separate excitation voltages to individual ring electrodes 41 or between pairs of ring electrodes. This allows ions having specific mass to charge ratios or ions having mass to charge ratios which specific ranges to be ejected axially from the array or moved to a new location within the array prior to or during radial excitation and ejection. A separate axial detector (not shown) may be positioned to record the arrival of these ions.

DC voltages may be applied to individual ring electrodes or between pairs of ring electrodes to modify the secular frequency and stability characteristics of ions within all or some of the array of ion traps. This allows different analytical mass selective ejection scans to be performed.

Figure 14:
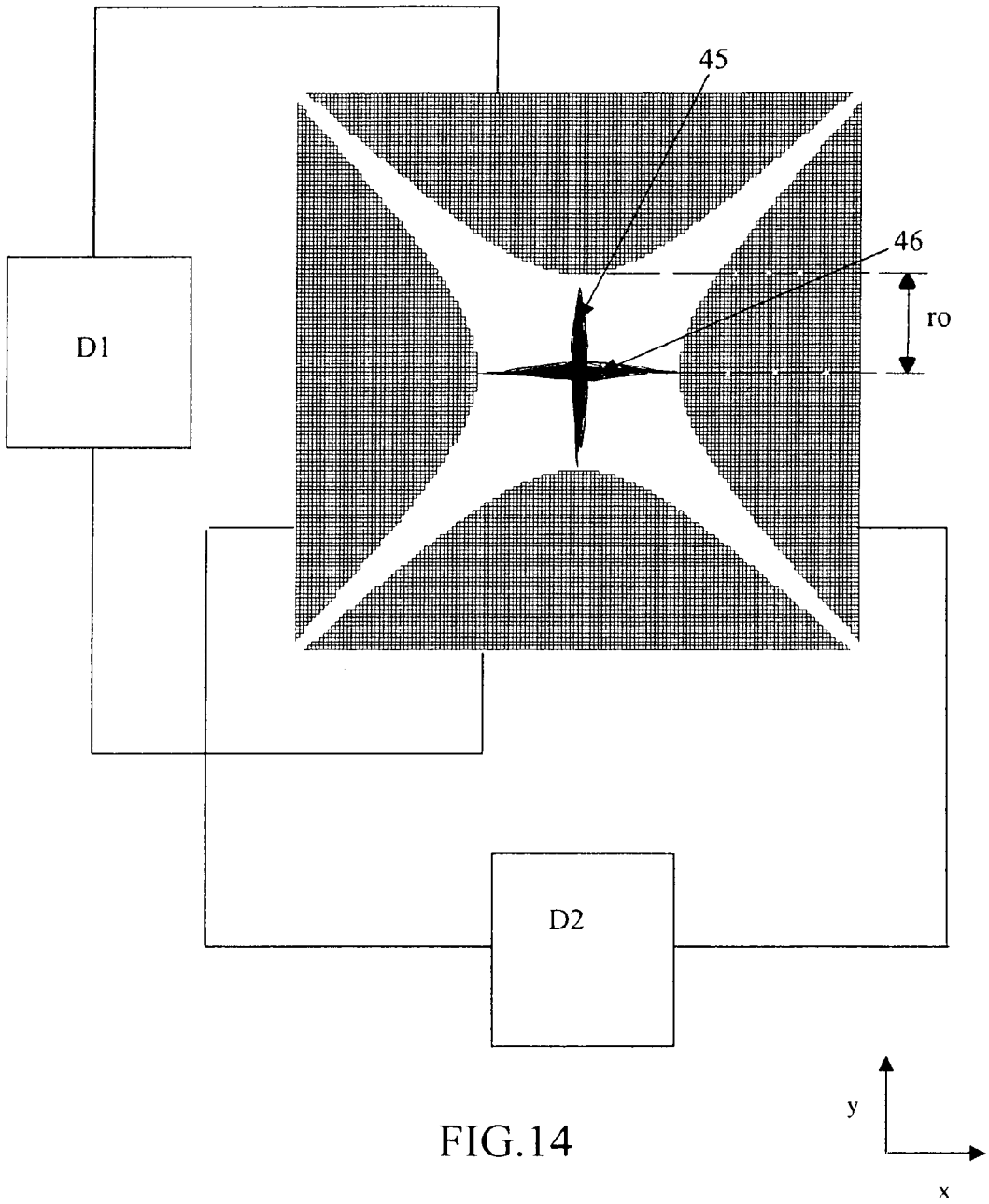
FIG. 14 shows a SIMION® model of the ion trajectories of two species of positive ions having different mass to charge ratios according to a preferred embodiment of the present invention.

FIG. 14 shows ion trajectories within a quadrupole rod set ion trap which were modelled using SIMION® ion optics software. The internal radius of the quadrupole rod set rod was modelled as being 5 mm. A confining RF voltage was modelled as being supplied between pairs of rods and was set at 400V pk-pk and had a frequency of 1 MHz.

Positive ions having mass to charge ratios of 200 and 210 were modelled as being introduced into the centre of the ion trap. A first dipole excitation voltage having an amplitude of 0.75 V and having a frequency of 313.5 kHz was modelled as being applied in the x direction using voltage supply D2. At the same time, a second dipole excitation voltage having an amplitude of 0.75 V and having a frequency of 337.4 kHz was modelled as being applied in the y direction using voltage supply D1. The ion trajectories shown in FIG. 14 show that ions having a mass to charge ratio of 210 were ejected in the x direction 46 at the same time that ions having a mass to charge ratio of 200 were ejected in the y direction 45.

Figure 15:
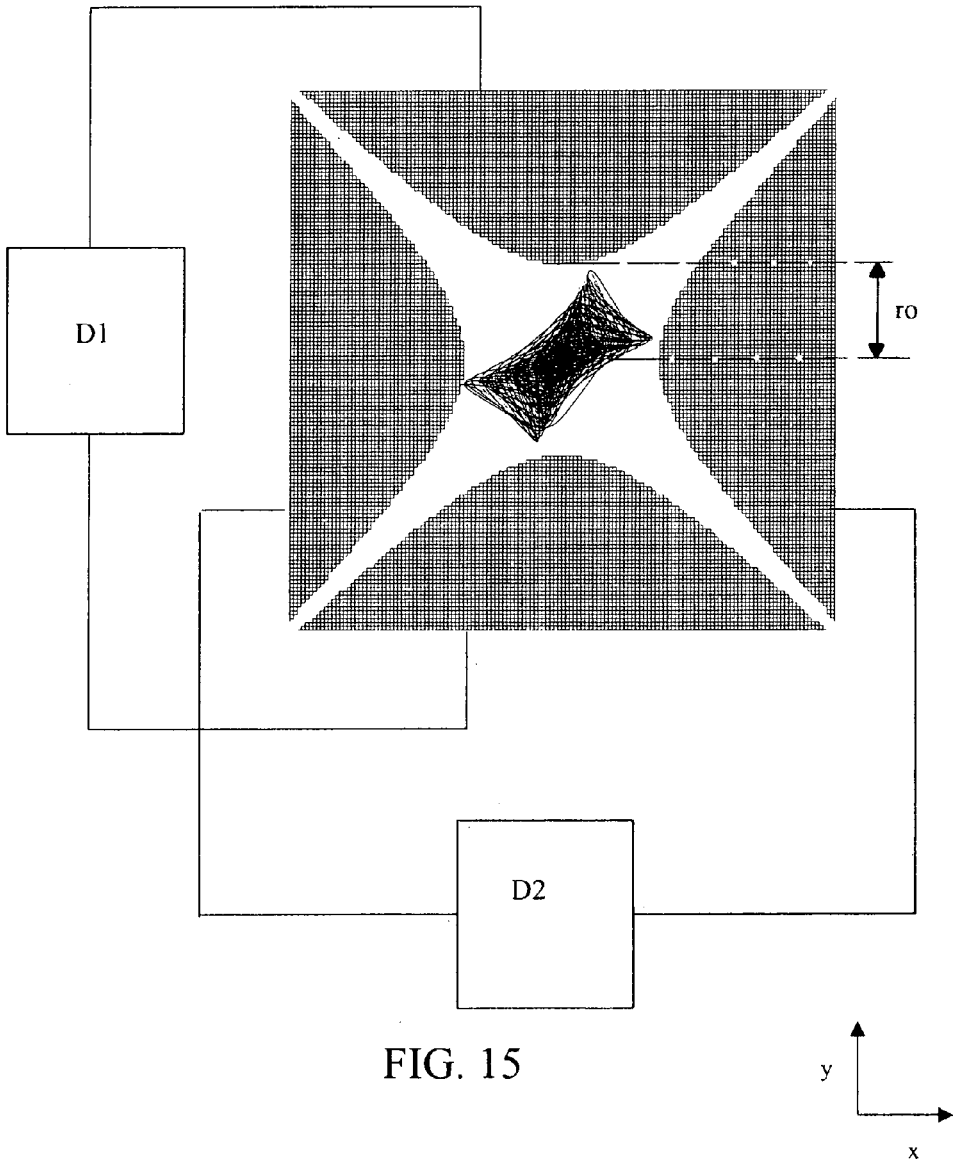
FIG. 15 shows a SIMION® model of the ion trajectories of positive and negative ions having identical mass to charge ratios without an DC voltage being applied to the electrodes.

FIG. 15 shows results from the same model as described above with reference to FIG. 14 except that in this example positive and negative ions having mass to charge ratios of 200 where modelled as being introduced into the ion trap. Both dipole excitation supplies D1 and D2 had an amplitude of 0.75 V pk-pk and had a frequency of 337.4 kHz. The amplitude of positive and negative ions increased simultaneously in both the y and the x directions.

Figure 16:
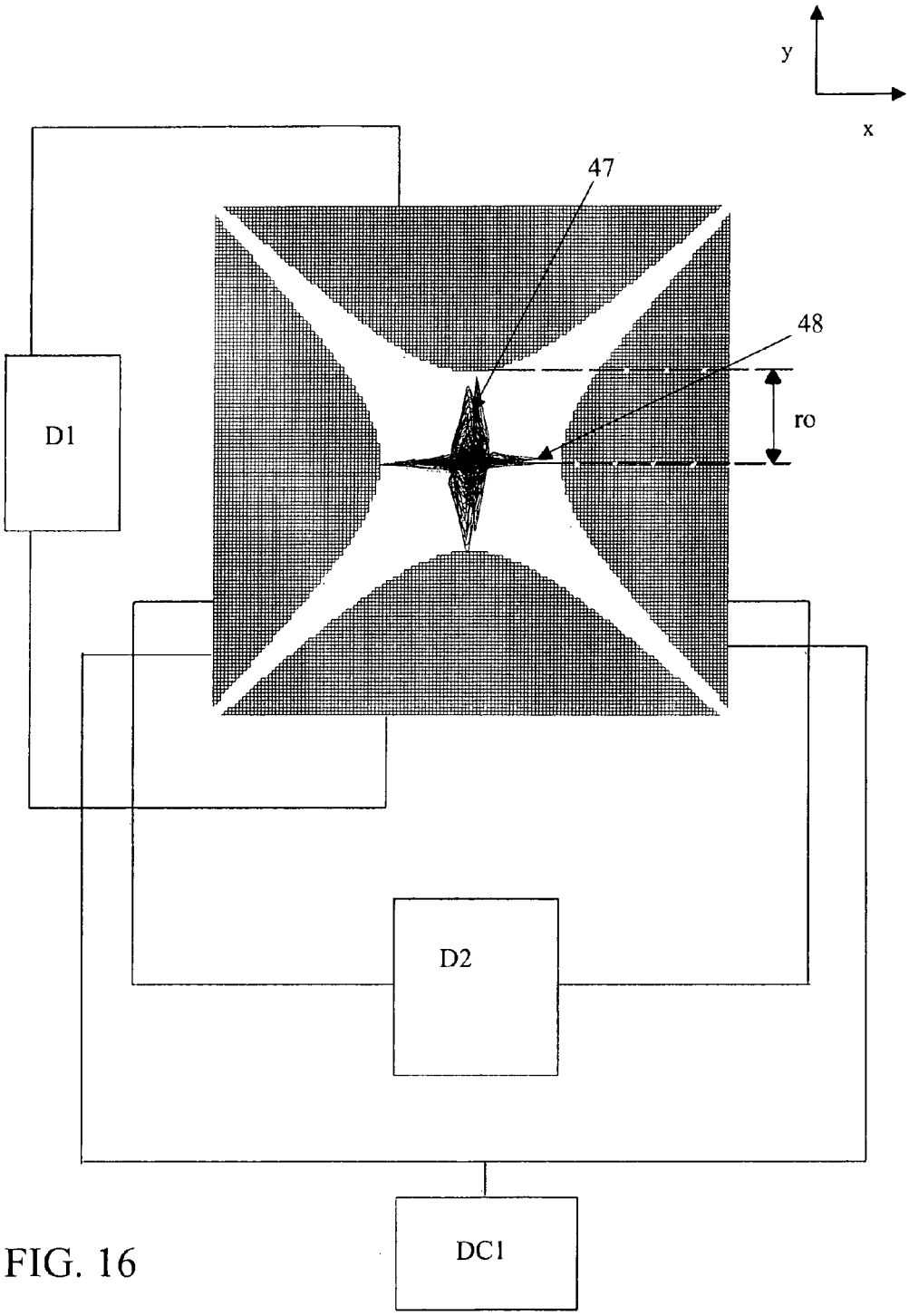
FIG. 16 shows a SIMION® model of the ion trajectories of positive and negative ions having identical mass to charge ratios wherein a DC voltage is applied to one pair of trapping electrodes.

FIG. 16 shows results from the same model as described above with reference to FIG. 15 wherein +10 V was applied to the pair of electrodes in the x direction using DC voltage supply DC1. The application of the DC voltage modified the frequency of ion oscillation for the positive and negative ions in a manner as described above. A dipole excitation voltage having an amplitude of 0.75 V and having a frequency of 356.5 kHz was applied in both the x and y directions. Positive ions 48 were excited and ejected in the x direction and negative ions 47 having the same mass to charge ratio were simultaneously excited and ejected in the y direction.

Mass selective axial ejection from linear quadrupole ion traps has also been demonstrated using axial resonance ejection from an axial quadratic DC potential valley in which ions are confined radially within an RF ion guide. Mass selective axial ejection from linear quadrupole ion traps has also been demonstrated using radial excitation in conjunction with field penetration effects from electrodes positioned at the end of the trapping electrodes. The methods of radial ejection described above can be used in conjunction with these methods of axial mass selective ejection to perform simultaneous axial and radial ejection of different mass to charge ratios in linear quadruple ion trap geometries.

Embodiments are also contemplated wherein a linear quadrupole geometry may be used as a standard quadrupole mass filter if required employing an axial detector. The device may then serve a dual purpose within a mass spectrometer either as a linear ion trap, or as a quadrupole mass filter.

The ion traps and methods of ejection described above may be used in conjunction with other mass analysers such as quadrupole mass filters, Time of Flight mass analysers or Orbitrap electrostatic ion traps.

The ion traps disclosed above may be used to perform precursor selection and fragmentation as part of $MS^n$ experiments. Multiple precursor ions may be fragmented simultaneously using the resonance methods described. Multiple fragment ions may then be analysed simultaneously.

Although the present invention has been described with reference to preferred embodiments, it will be understood by those skilled in the art that various changes in form and detail may be made to the particular embodiments discussed above without departing from the scope of the invention as set forth in the accompanying claims.

The invention claimed is:

1. An ion trap comprising a plurality of axial segments, arranged in series, wherein each axial segment comprises a plurality of electrodes and each axial segment is operable in a first mode of operation so that ions having substantially different mass to charge ratios or opposite polarities are passed between the axial segments and simultaneously ejected via different exit paths from said each axial segment.

2. An ion trap as claimed in claim 1, wherein at least some of said plurality of electrodes have one or more holes, slots or apertures, wherein ions having a first mass to charge ratio or a first polarity are arranged and adapted to exit said plurality of electrodes solely via a first exit path which passes through one or more first holes, slots or apertures and wherein ions having a second different mass to charge ratio or a second opposite polarity are arranged and adapted to exit the segment solely via a second different exit path which passes through one or more second different holes, slots or apertures.

3. An ion trap as claimed in claim 1, wherein in said first mode of operation ions having opposite polarities but substantially similar mass to charge ratios are simultaneously or sequentially ejected from said ion trap via different exit paths.

4. An ion trap as claimed in claim 1, wherein in said first mode of operation ions having mass to charge ratios within a first range having a lower limit and an upper limit and ions having mass to charge ratios within a second different range having a lower limit and an upper limit are simultaneously or sequentially ejected from said ion trap via different exit paths, and wherein the lower or the upper limit of said first range or the lower or the upper limit of said second range is varied, increased, decreased, stepped or scanned during a scan period.

5. An ion trap as claimed in claim 1, wherein in said first mode of operation either:

(a) ions having mass to charge ratios within a first range or ions having a first polarity are arranged and adapted to exit said ion trap solely in a first radial direction; or (b) ions having mass to charge ratios within a second different range or ions having a second polarity opposite to said first polarity are arranged and adapted to exit said ion trap solely in a second different radial direction; or (c) ions having mass to charge ratios within a third different range are arranged and adapted to exit said ion trap solely in an axial direction.

6. An ion trap as claimed in claim 1, further comprising a device arranged and adapted to eject ions from said ion trap by mass selective instability.

7. An ion trap as claimed in claim 1, further comprising a device arranged and adapted to apply a dipolar excitation waveform to said electrodes in order to eject ions from said ion trap; and comprising:

a first auxiliary AC or RF voltage supply for supplying a first auxiliary AC or RF voltage to said electrodes, wherein said first auxiliary AC or RF voltage is arranged, in use, to excite or eject ions in a first direction; and a second auxiliary AC or RF voltage supply for supplying a second auxiliary AC or RF voltage to said electrodes, wherein said second auxiliary AC or RF voltage is arranged, in use, to excite or eject ions in a second different direction.

8. An ion trap as claimed in claim 1, further comprising a device arranged and adapted to apply a quadrupolar or parametric excitation waveform to said electrodes in order to eject ions from said ion trap.

9. An ion trap as claimed in claim 1, wherein said plurality of axial segments comprise 2D ion traps, wherein each 2D ion trap comprises a linear ion trap or a plurality of elongated rods or electrodes.

10. An ion trap as claimed in claim 1, wherein said plurality of axial segments comprise 3D ion traps, wherein each said 3D ion trap comprises at least one central ring electrode.

11. A mass spectrometer comprising an ion trap as claimed in claim 1, further comprising one or more first ion detectors arranged to detect ions which exit said ion trap via a first exit path and one or more second separate ion detectors arranged to detect ions which exit said ion trap via a second different exit path.

12. An ion trap as claimed in claim 1, further comprising an entrance electrode and an exit electrode arranged with the plurality of axial segments located between the entrance electrode and the exit electrode, each said axial segment being formed without an entrance electrode or an exit electrode and, in the first mode of operation, the entrance and exit electrodes trap the ions within the plurality of axial segments but the ions still pass between the segments.

13. A method of trapping ions with an ion trap comprising a plurality of axial segments, arranged in series, each segment having a plurality of electrodes and multiple, different exit paths, the method comprising:

passing ions between the axial segments while simultaneously applying one or more voltages to the plurality of electrodes in each segment so that ions having substantially different mass to charge ratios or opposite polarities are simultaneously ejected from each segment via the multiple, different exit paths.

14. A 3D ion trap comprising:

a central ring electrode comprising a plurality of radial segments wherein one or more of said radial segments have a slot, hole or aperture through which ions are ejected in use.

15. A 3D ion trap as claimed in claim 14, wherein said 3D ion trap further comprises one or more end-cap electrodes;

and wherein ions having a first mass to charge ratio or a first polarity are arranged and adapted to exit said ion trap solely via a first exit path, pathway or route which passes through one or more first holes, slots or apertures in said central ring electrode and wherein ions having a second different mass to charge ratio or a second opposite polarity are arranged and adapted to exit said ion trap solely via a second different exit path, pathway or route which passes through one or more second different holes, slots or apertures in said central ring electrode.

* * * * *

UNITED STATES PATENT AND TRADEMARK OFFICE

CERTIFICATE OF CORRECTION

PATENT NO. : 8,519,331 B2
APPLICATION NO. : 12/528173
DATED : August 27, 2013
INVENTOR(S) : Robert Harold Bateman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 973 days.

Signed and Sealed this
Nineteenth Day of April, 2016

Michelle K. Lee

Michelle K. Lee
*Director of the United States Patent and Trademark Office*